United States Patent [19]

Burt

[11] Patent Number: 4,989,430

[45] Date of Patent: Feb. 5, 1991

[54] LATCH MECHANISM

[75] Inventor: Arthur J. Burt, Ipswich, Great Britain

[73] Assignee: Titon Hardware Limited, Cholchester, England

[21] Appl. No.: 443,132

[22] Filed: Nov. 29, 1989

Related U.S. Application Data

[63] Continuation-in-part of Ser. No. 267,887, Nov. 7, 1988, abandoned.

[30] Foreign Application Priority Data

Nov. 5, 1987 [GB] United Kingdom ..... 8725977

[51] Int. Cl.[5] ..... E05B 17/04

[52] U.S. Cl. ..... 70/380; 292/336.5

[58] Field of Search ..... 70/379 R, 380; 292/35 B, 359, 336.5, DIG. 27

[56] References Cited

U.S. PATENT DOCUMENTS

| | | | |
|---|---|---|---|
| 1,672,711 | 6/1928 | Cummings | 292/336.5 |
| 1,685,317 | 9/1928 | Devereaux | 292/336.5 |
| 2,702,204 | 2/1958 | Collier | 292/358 |
| 3,554,147 | 12/1970 | James . | |
| 3,883,164 | 5/1975 | Galbreath et al. . | |
| 4,073,527 | 2/1978 | Schlage | 292/347 |

FOREIGN PATENT DOCUMENTS

| | | |
|---|---|---|
| 348700 | 9/1972 | Sweden . |
| 1014173 | 12/1965 | United Kingdom . |
| 1474652 | 5/1977 | United Kingdom . |
| 2070128 | 9/1981 | United Kingdom . |
| 2170550 | 8/1986 | United Kingdom . |
| 2170551 | 8/1986 | United Kingdom . |
| 2170552 | 8/1986 | United Kingdom . |

OTHER PUBLICATIONS

British Standard PS 5872 (1980).

*Primary Examiner*—Robert L. Wolfe

*Attorney, Agent, or Firm*—Millen, White & Zelano

[57] ABSTRACT

A latch mechanism for a door or the like includes first and second rotatable latch operating members which operate a latching bolt or the like. An axially movable square section spindle extends through complementary holes in both members. In an engaged position, the spindle operates both members when rotated. In a disengaged position, a circular section portion of the spindle registers with a hole in one of the members. In the disengaged position the bolt can be operated by the first member even though the second member may be prevented from rotating by means of pins. The spindle can be moved between engaged and disengaged positions by a push-rod extending out of the door. Thus, when the second member is locked it may be overriden by actuation of the rod and the first member.

10 Claims, 3 Drawing Sheets

LATCH MECHANISM

This invention is a continuation in part of U.S. patent application Ser. No. 267,887 filed 7th November, 1988, now abandoned.

BACKGROUND TO THE INVENTION

This invention relates to operating means for a latch, for example, a door latch.

A door latch set as conventionally used comprises an insert fitted into the free edge of the door between its front and back surfaces having a bolt which in its extended position protrudes beyond the edge of the door into a recess in the door frame and in its retracted position is wholly within the door to allow the door to be opened. The bolt is conventionally moved between its retracted and extended positions by rotation of an element of the latch set by rotation of a square section spindle extending through the door. Rotation of the spindle is usually effected by action of a door handle or knob on the spindle. The bolt will usually be biased to its extended position.

The bolt may be lockable in the extended or retracted position by a mechanism which prevents rotation of the handle or knob.

In addition to the type of latch set which uses a rotating handle or knob there is a further type of latch operating means which uses a linear rather than rotary action to move the latch bolt between its retracted and extended positions. Several latch operating means utilising a linear movement towards or away from the door to retract or extend the latch bolt appear in Swedish Patent No. 348700, UK Patent No. 2070128 and UK Patent Applications Nos. 8602700, 8602701 and 8602702.

The present invention is concerned with improvements to latch operating sets comprising first and second latch operating means to be located respectively on opposite sides of a door or the like, each latch operating means being connected through a latch operating member to a latch operating spindle such that operation of the latch operating means causes rotation of the appropriate latch operating member and thereby of the spindle. The spindle may be of the square type such as is defined in British Standard BS No. 5872 (1980) for latching sets, or indeed of any other section of varying radius to provide the necessary camming action. This type of latch operating set will be referred to in this specification as a latch set "of the type specified".

BRIEF SUMMARY OF THE INVENTION

According to the present invention a latch mechanism for a closure in a frame, comprises latch means for holding said closure in said frame, said latch means including first and second independently rotatable latch operating members each defining a recess, a latch actuating spindle and first and second latch actuating means for applying a latch actuating torque to said spindle from first and second sides of said closure, respectively, wherein said first latch operating member has locking means for preventing rotation of the spindle from the first side, and said second latch operating member has locking means which are operable from the second side to prevent rotation of said second latch operating member, said first latch actuating means being permanently engaged with said spindle to transmit said torque and said spindle being axially displaceable between an engaged position, in which said spindle is engaged in said recess defined by said second latch operating member to transmit said torque, and a disengaged position, in which said spindle and second latch operating member are free to rotate independently.

In a preferred form that involves provision of the spindle with a part of its length having a cross-sectional shape such that its maximum radius about the spindle axis is less than the minimum radius of the latch operating member. In a preferred form the latch operating member will have a square recess adapted to receive a square section spindle of substantially the same size, a part of the length of the spindle being turned to a circular cross-section such that it will rotate freely within the square section recess of the latch operating member. The part of the spindle having its maximum sectional radius less than the minimum sectional radius of the spindle engaging part of the latch operating member will be referred to as the slipping section of the spindle. The slipping section of the spindle may be located at one distal end of the spindle or it may be located between the ends. In a further form of the invention the movement of the spindle may be to remove it entirely from the position where it shares a cross-sectional plane with the relevant latch operating member.

Preferably, the second latch operating means include pawl means comprising a pin which is insertable into the second latch operating member to prevent rotation thereof with respect to the closure or frame to which it is secured.

The movement of the spindle with respect of a latch operating member may have two different effects. In one form the movement of the spindle will disengage e.g. the handle of one latch operating means from the spindle so that that handle cannot be used to operate the latch. This in effect locks the door. Alternatively, the movement of the spindle may be to permit slip between the latch operating member of a locked latch operating means on one side of the door so that the latch operating means on the other side of the door may be used to operate the latch. In that arrangement the latch operating means on the latter, "other" side of the door must be provided with a mechanism to achieve the linear movement of the spindle inwardly or outwardly.

The present invention is particularly applicable to latch operating sets as used on hotel doors. Hotel doors need to be locked either from the inside or the outside. The outer latch operating means will normally be locked using a key and the inner by manual operation on some feature of the inner latch operating means. It would normally be expected that the fact of locking the inner latch operating means will prevent what might be called a first level of access from outside a room. That first level of access may be such as is required by hotel staff in normal cleaning operations which a hotel guest may wish to prevent. Nonetheless a second level of access will be required, for example, if the hotel management considers it appropriate to gain entry to the room against the occupant's intention. A typical arrangement to provide for that second level of access would have involved a master or override key available to the hotel management. With the present invention a simple mechanism may be provided on the outer latch operating means, for example, a push rod which can be operated through a small hole in the outer latch operating means itself to push the latch operating spindle into a position where the latch operating member of the inner latch operating means is located in the slipping section of the spindle. In that position the outer latch operating means may be used to rotate the latch operating spindle in the usual way.

The present invention therefore provides a substantial degree of simplification to achieve the objective of overriding one latch operating means from the other side of the door. In addition to hotel door latch operating sets, a similar arrangement may find use, for example, on bathroom/lavatory latch operating sets where emergency access may be required, for example, as a result of illness or accident befalling the occupant.

BRIEF DESCRIPTION OF DRAWINGS

The present invention may be put into practice in various ways, and a specific embodiment of the invention will now be described, by way of example, with reference to the accompanying drawings in which.

DETAILED DESCRIPTION

Figure 5:
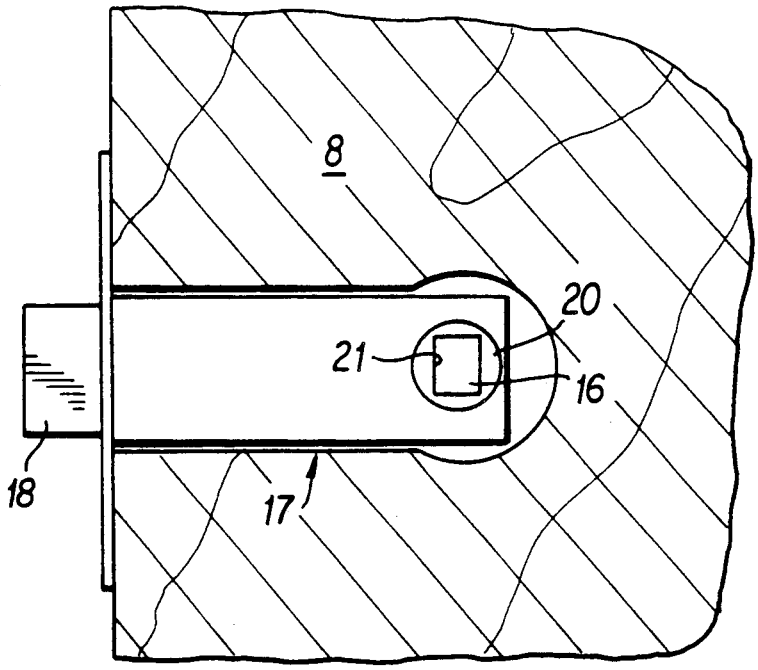
FIG. 5 is a cross-section of a door latch in a door.
Figure 6:
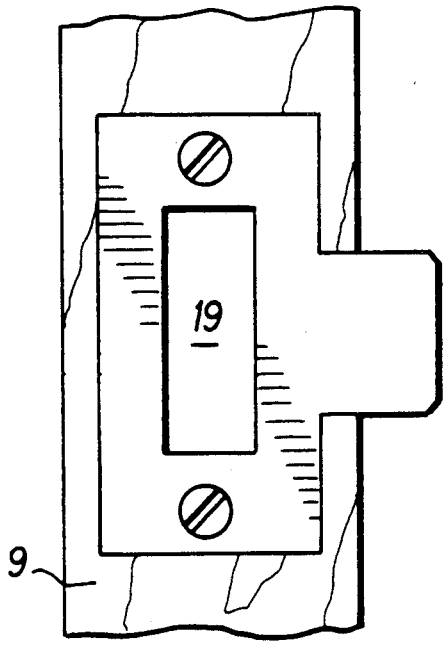
FIG. 6 is an end view of a door latch keep in a door frame.

Referring to the drawings there is shown a part of a latch operating set of the type suitable for use on a hotel room door 8. The latch operating set comprises outer latch operating means 12 and inner latch operating means 14 connected by a latch operating spindle 16. The latch operating spindle 16 is generally of square section, for example, as specified in British Standard BS No. 5872 (1980) referred to above. The spindle 16 passes through a square section recess in a conventional door latch set 17 (see FIG. 5) of the type falling within BS No. 5872 (1980) so that rotation of the spindle 16 about its axis will cause retraction or extension of a latch bolt 18 of the door latch set. The bolt 18 is received in a recess 19 in a door frame 9. The mechanism has located generally at 20 a latch operating member which has a square hole 21 engaging around a part of the spindle 16. That latch operating member 20 is connected through a lock body shown at 24 to a key/barrel lock arrangement shown at 26. The internal workings of the barrel lock are conventional and are not shown in detail in the drawings. When the correct key (not shown) is inserted into the key/barrel arrangement 26 and rotated, the connecting tongue 25, slidably received in a recess in the spindle 16, will cause the latch operating member 20 to rotate as it turns the spindle 16, thereby operating the door latch set.

The latch operating means 14 are similarly provided with a latch operating member 22 which defines a square section recess located around a further square section 32 of the spindle 16. The member 22 rotates with a body portion 33 held in the aperture in the door 8 by a keep plate 35. The body 33 and latch operating member 22 are fixed to rotate together. The latch operating means 14 are provided with a handle arrangement (not shown) attached to the body 33 to rotate the latch operating member 22 and thereby rotate the spindle 16 and the door latch set. The latch operating means 14 are also provided with a mechanism such as an axially slidable member which can be pushed manually to effect engagement of pawl pins 28 slidably mounted in that portion 39 of the internal latch operating means 14 which is fixed to the door 8 into recesses 37 in the rotatable latch operating member 22. The movement of the pins 28 is indicated by the double-headed arrows in FIGS. 1 and 4.

Figure 1:
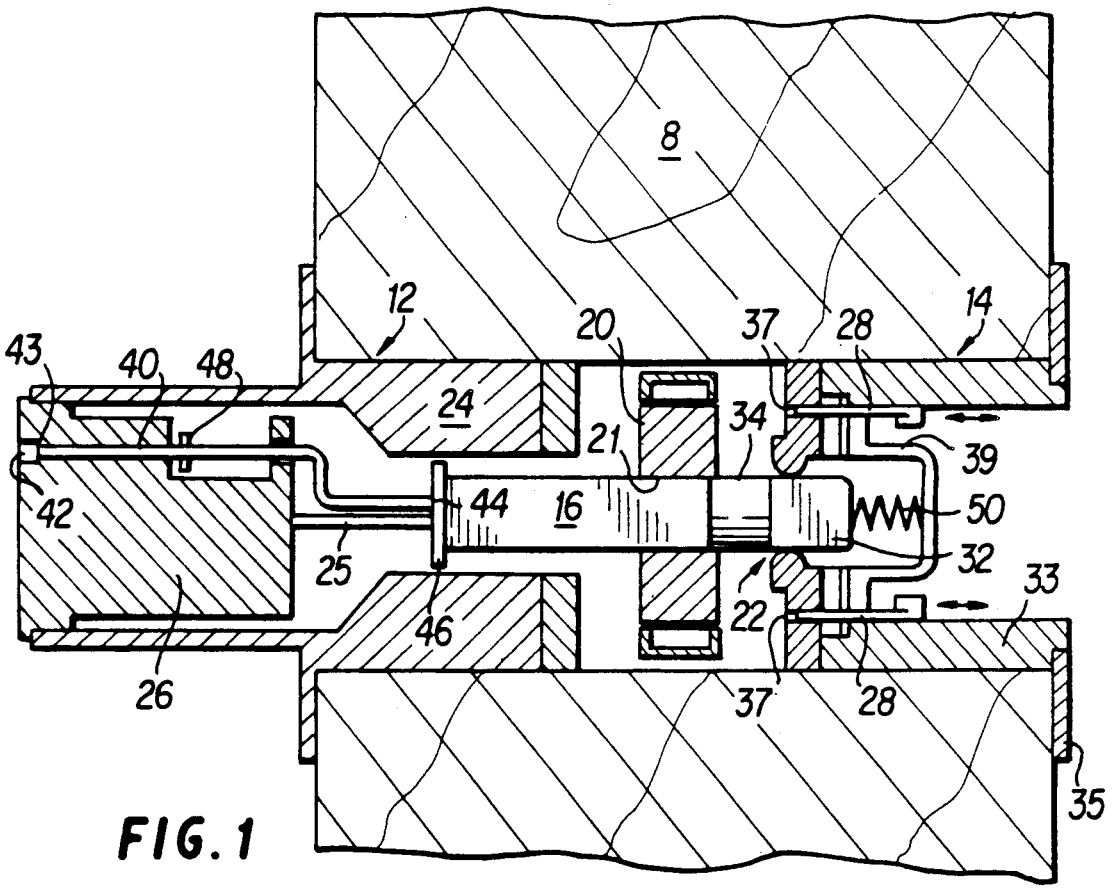
FIG. 1 is a schematic section showing the relative positions of the latch operating spindle, latch operating members and a release mechanism of a latch operating set according to the present invention.
Figure 2:
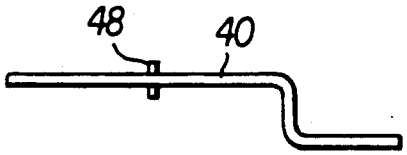
FIG. 2 shows the release member of the arrangement of FIG. 1.
Figure 3:
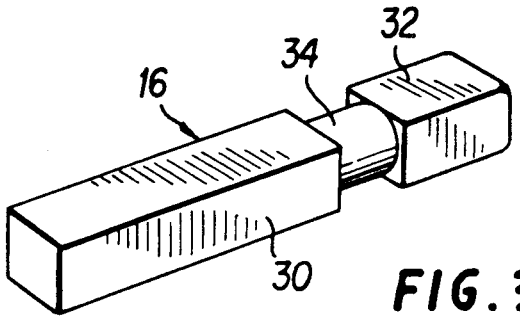
FIG. 3 is a perspective of the latch operating spindle of FIG. 1.

The locking mechanism is intended to be used, for example, by a room occupant to prevent what was previously referred to as a first level of access to the room from outside. In that position, with the door operating means 14 "locked", by the engaged pins 28, operation of the key/barrel arrangement 26 will be prevented because of engagement of the square section 32 of the spindle with the now rotationally fixed latch operating member 22. This is illustrated in FIG. 1.

If access is nonetheless required to the room by the hotel management, some means of overriding the "locked" state of the latch operating means 14 is required. That mechanism is provided by a cranked release pin 40 which passes through a hole 42 in the key/barrel arrangement 26. One end 43 of the release pin 40 is located just within the hole 42 whereas the other end 44 of the release pin 40 abuts a plate 46 affixed to the outer end of the spindle 16. The release pin 40 has affixed to it a collar 48 to limit its movement. A spring 50 is provided at the other end of the spindle 16 to bias the spindle 16 in the outwards direction into engagement with the end 44 of the release pin 40.

Figure 4:
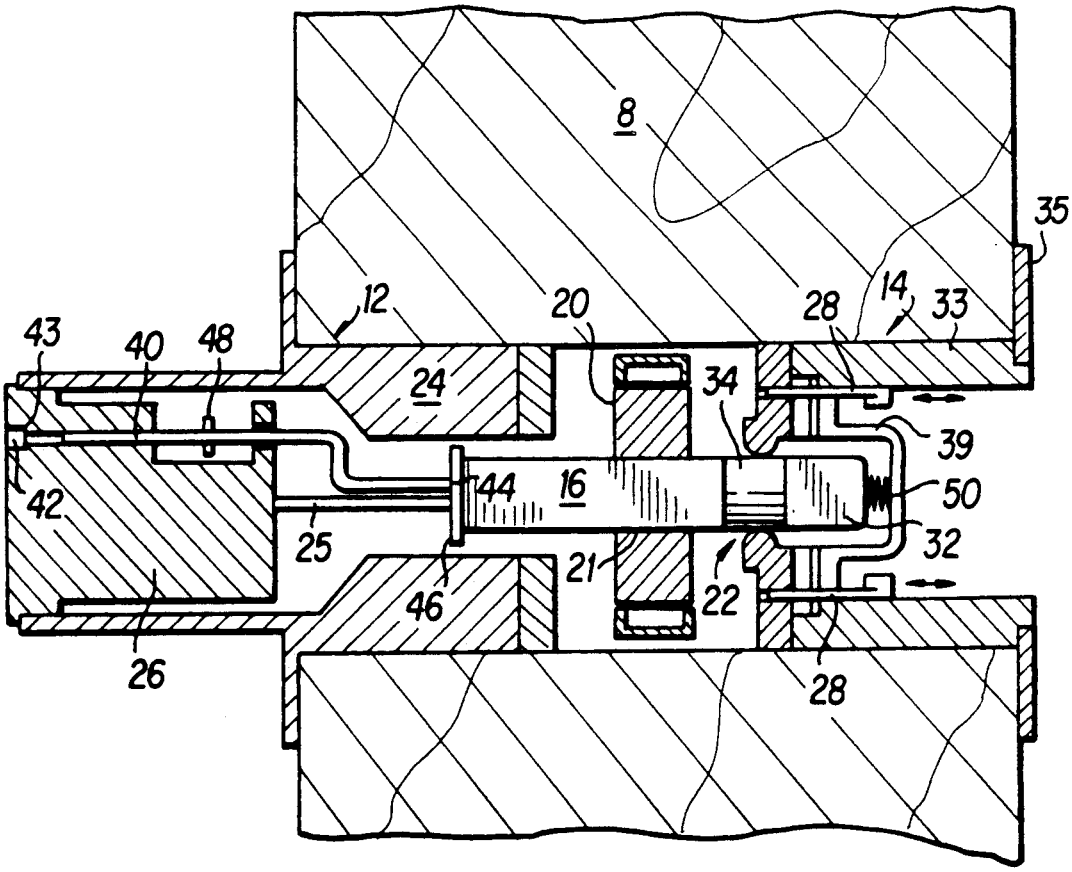
FIG. 4 is a schematic section showing the mechanism of FIG. 1 with the spindle displaced.

The spindle 16 is provided with a turned circular section 34 which has as its diameter the width of the square sections 30/32 of the spindle 16. When a pin or plunger (not shown) is inserted into the hole 42, force on that pin will be transmitted through the cranked release pin 40 to the spindle 16 causing it to move inwardly, sliding relative to the tongue 25, in the right-hand direction as shown in FIG. 1. The force will be against that of the spring 50, mounted in the fixed portion 39. The resulting movement continues to the point where the latch operating member 22 is located around the circular or slippage section 34 of the spindle 16. This is illustrated in FIG. 4. In that position the key/barrel arrangement 26 may be rotated in the usual way, causing rotation of the spindle 16 through the latch operating member 20, unhindered by the fact that the latch operating means 14 and consequently the latch operating member 22 may be locked and thereby prevented from rotating. That enables the bolt of the door latch set to be retracted and access to the room thereby gained, despite the locked state of the inner latch operating means 14 by virtue of the engagement of the pins 28.

I claim:

1. A latch mechanism for a closure in a frame, comprising latch means for holding said closure in said frame, said latch means including first and second independently rotatable latch operating members each defining a recess, a latch actuating spindle and first and second latch actuating means for applying a latch actuating torque to said spindle from first and second sides of said closure, respectively, wherein said first latch operating member has locking means for preventing rotation of the spindle from the first side, and said second latch operating member has locking means which are operable from the second side to prevent rotation of said second latch operating member, said first latch actuating means being permanently engaged with said spindle to transmit said torque and said spindle being axially displaceable between an engaged position, in which said spindle is engaged in said recess defined by said second latch operating member to transmit said torque, and a disengaged position, in which said spindle and second latch operating member are free to rotate independently.

2. A mechanism as claimed in claim 1, in which said spindle comprises a portion of non-circular section.

3. A mechanism as claimed in claim 1, in which said recess in said second latch operating member is a hole and said spindle also comprises a circular section portion which registers with said hole when said spindle is in said disengaged position.

4. A mechanism as claimed in claim 3 in which said circular section portion is formed between ends of said spindle.

5. A mechanism as claimed in claim 1 in which said spindle is displaceable by means of a push-rod abutting or attached to an end of said spindle remote from said second latch operating member.

6. A mechanism as claimed in claim 1, in which said first latch actuating means comprise a key actuated lock assembly.

7. A mechanism as claimed in claim 1, in which said locking means of said second latch actuating means include pawl means which are engageable with said second latch operating member to prevent actuation of said latch means by said second latch actuating means.

8. A mechanism as claimed in claim 7, in which said pawl means comprise a pin or pins which is/are insertable into said second latch operating member to prevent rotation thereof with respect to said closure to which it is secured.

9. A mechanism as claimed in claim 1, in which said spindle is biased to said engaged position.

10. A door including a mechanism as claimed in claim 1.

* * * * *